United States Patent [19]

Hilbert

[11] 4,226,077

[45] Oct. 7, 1980

[54] METHOD AND APPARATUS FOR MANUFACTURING WRAPPED YARNS

[75] Inventor: Richard G. Hilbert, Smithfield, R.I.

[73] Assignee: Leesona Corporation, Warwick, R.I.

[21] Appl. No.: 18,721

[22] Filed: Mar. 8, 1979

Related U.S. Application Data

[63] Continuation-in-part of Ser. No. 947,137, Sep. 29, 1978, abandoned.

[51] Int. Cl.[3] ..... D02G 3/36; D01H 7/18; D01H 11/00

[52] U.S. Cl. ..... 57/18; 57/352; 57/354

[58] Field of Search ..... 57/16–18, 57/6, 300, 352, 354

[56] References Cited

U.S. PATENT DOCUMENTS

| | | | |
|---|---|---|---|
| 3,328,946 | 7/1967 | Schumann et al. | 57/18 |
| 3,478,506 | 11/1969 | Kawashima | 57/18 X |
| 3,493,017 | 2/1970 | Govaert | 57/18 X |
| 3,831,369 | 8/1974 | Northup et al. | 57/18 X |
| 3,899,867 | 8/1975 | Northup et al. | 57/18 |
| 3,927,515 | 12/1975 | Northup et al. | 57/18 |
| 4,018,042 | 4/1977 | Maag et al. | 57/18 X |
| 4,028,874 | 6/1977 | Maag et al. | 57/18 X |

*Primary Examiner*—John Petrakes
*Attorney, Agent, or Firm*—Burnett W. Norton

[57] ABSTRACT

Method and apparatus for producing high quality wrapped yarn by a wrapping operation wherein a binder strand, carried by a supply package supported by a rotatably driven hollow spindle, is fed to the free end of the hollow supply spindle and wrapped around a core strand moving through the hollow spindle. The binder strand inherently balloons outwardly in its path of travel from its rotating supply package to the core strand being wrapped. The zone in which the binder strand balloons is enclosed to isolate it from the ambient air about the wrapping apparatus to thereby substantially preclude pick up of fiber waste on the binder strand. Suction means communicates with the hollow spindle to attract the core yarn and facilitate passage of the wrapped yarn therethrough. Isolation of the zone in which the binder strand balloons is obtained by enveloping the package and balloon-forming region of the binder strand with an enclosure. The top of the enclosure is provided with an aperture to permit the delivery of core strand through the enclosure to the hollow spindle. Preferably, the inside margins around the enclosure aperture are designed to define with the adjacent end face of the hollow spindle an annular radially extending passageway for passage of the binder yarn, and means are provided to adjust the spacing between the hollow spindle end face and the aperture margins to optimize the exclusion of fiber waste from the ballooning zone.

25 Claims, 15 Drawing Figures

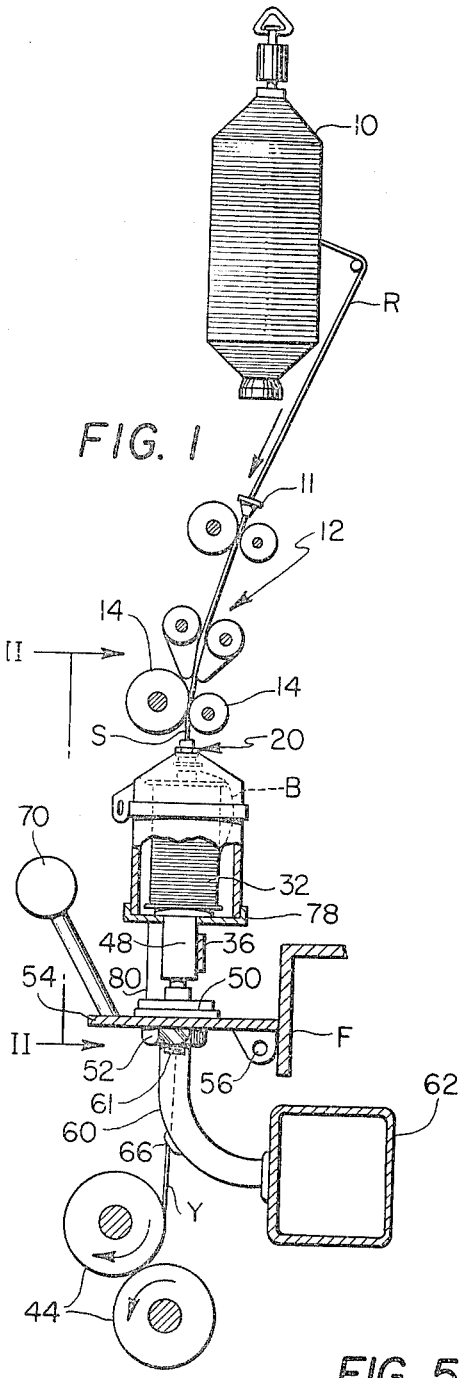
FIG. 1
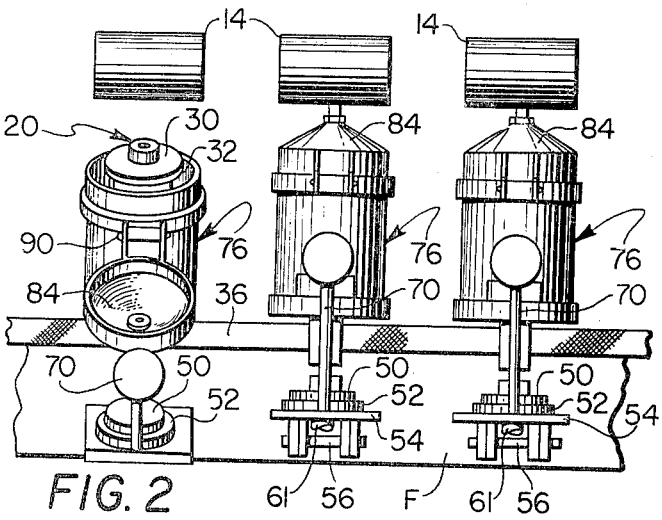
FIG. 2
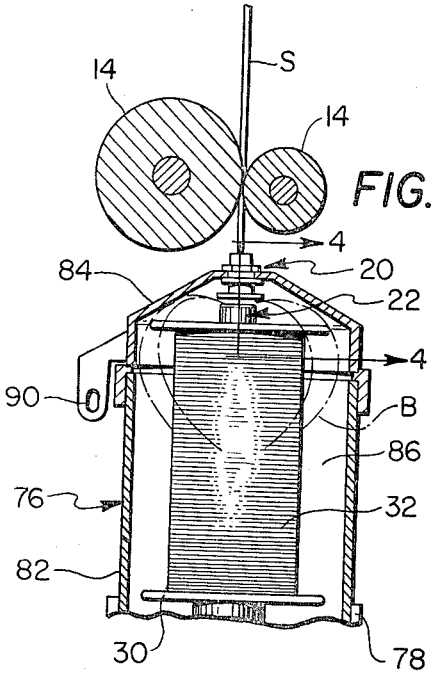
FIG. 3
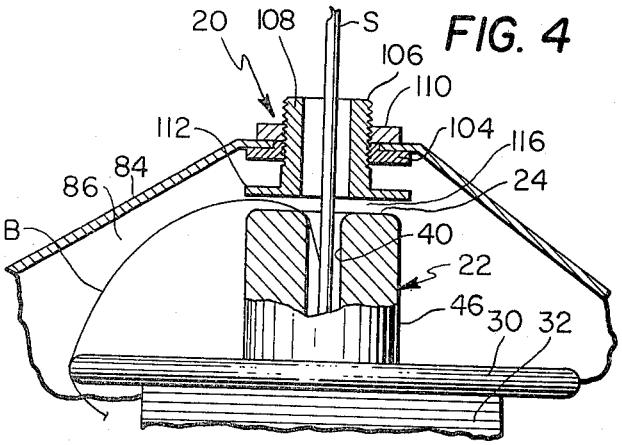
FIG. 4
FIG. 5
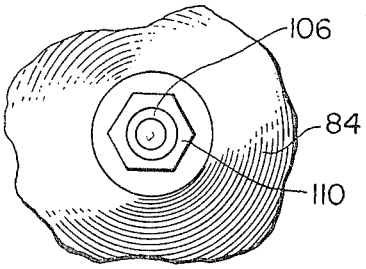

METHOD AND APPARATUS FOR MANUFACTURING WRAPPED YARNS

CROSS REFERENCE TO RELATED APPLICATION

This application is a Continuation-in-Part of commonly assigned U.S. application Ser. No. 947,137 filed Sept. 29, 1978, now abandoned.

BACKGROUND OF THE INVENTION a. Field of the Invention

The present invention relates to method and apparatus for manufacturing wrapped yarns and relates, more particularly, to methods and apparatus for manufacturing wrapped yarns formed of a central core of roving or the like drafted yarn which is helically wrapped with a binder strand.

In the following specification, the terms "yarn" and "strand" are used in a general sense to apply to all kinds of strand material, either textile or otherwise, and the terms "package" and "spool" are intended to mean the product of a winding machine, whatever its form. The term "balloon" refers to the path defined by the rotating portion of a rotated advancing strand irrespective of the shape or diameter of said path, and sometimes refers to the yarn in said path, according to the context in which the term is employed.

b. Problem of the Invention

In the art of manufacturing wrapped yarn in which a cover or binder strand is helically wrapped around a drafted core strand or strands to form such wrapped yarn, a tendency for loose fibers escaping from the drafting system and other airborne waste to collect on the binder strand can be observed. When such waste does collect on the binder strand it eventually forms enlarged areas on the binder strand which can ultimately become wrapped into the final yarn product, thereby reducing the quality of that yarn and product. Alternatively, such collections or airborne waste on the binder strand contribute to high tensions in the binder strand especially in the area where the balloon is formed and lead to eventual breakage of the binder strands of the wrapped yarn.

It is, therefore, a primary object of the invention to provide an improved method and apparatus for obtaining high quality wrapped yarns while substantially reducing or eliminating loss in product quality due to the ballooning binder strand picking up airborne fiber waste thereon while being wrapped around a core strand.

Most wrapped or covered yarns are formed by directing a core strand through a hollow spindle as a ballooning binder strand is being withdrawn from a rotating package on the spindle and is being wrapped around the core strand. In some instances it is particularly desirable, if not necessary, that the wrapping of the core strand be effected closely adjacent to the entrance of the hollow spindle in which the core strand is being directed since the hollow spindle then aids in better controlling wrapping of the binder strand about the core strand and in guiding the core strand during the wrapping process. This is particularly the case in the formation of a wrapped yarn having a core strand formed of drafted, generally untwisted staple fibers about which a binder strand is being wrapped.

Typical apparatuses for forming wrapped yarns are disclosed in U.S. Pat. Nos. 3,328,946; 3,831,369, and 4,018,042.

As is well known, substantial amounts of fiber waste in the form of fine airborne waste fibers, or, in the parlance of the textile industry, "fly", are generated by textile machines which process staple fibers and form textile strands therefrom. It has been observed that a substantial amount of this fly is actually derived from the roving being drafted, and this, a substantial amount of the fly proximate any given wrapping station is probably generated by the roving or core strand being processed at that station. It can be appreciated, therefore, that substantial amounts of fiber waste generally are present in the ambient air adjacent machines for wrapping binder strands about core strands formed of untwisted staple fibers. It is also well known that, during the formation of a wrapped yarn in the manner indicated in the above, the binder strand inherently balloons outwardly its path of travel from the package to the core strand being wrapped, i.e., a rapidly rotating ballooning binder strand is present between each binder strand package and the end of the corresponding spindle adjacent which the binder strand is being wrapped around the rest of core strand. Such rapidly rotating ballooning binder strand attracts fiber waste from the ambient air during rotation thereof and while some of the picked up fiber waste is likely thrown off the ballooning binder strand by centrifugal force, much of the fiber waste adheres to the rotating ballooning strand.

Heretofore, in many instances, the fiber waste picked up by the rotating ballooning binder strands stays adhered thereto and grows in size until substantial masses or wads of fiber waste, i.e., so called "flags", are formed on the binder strands. Frequently, the flags are continuously "skinned" back along the binder strand by centrifugal forces and collect in the ballooning area of the binder strand until the ballooning binder strand eventually breaks. Alternatively, some of such wads of accumulated fiber waste would eventually cling to the binder strand and no longer be "skinned" back but, rather, would be carried along with the binder strand and wrapped about the core strand, thus resulting in objectionable slubs or enlarged places in the wrapped yarn being formed. Such defects, of course, reduce the quality of the wrapped yarn. Also, such defects would often cause breakage of the wrapped yarn in subsequent processes such as during passage of the wrapped yarn through the yarn guides and needles of knitting machinery or through stop motions, heddles and reeds of weaving machinery. Further, in rewinding operations, where the wrapped yarn is rewound in cones, it is usual to advance the yarn through a slub catcher during the rewinding operation where the detected slubs are cut out of the yarn then being retied and the rewinding operation continued. Obviously, if the wrapped yarn possesses numerous slubs or flags of objectionable size, the rewinding equipment is going to result in reduced production as it is stopped to tend to removal of the flags. Further, the rewound yarn will have a knot therein where each flag has been cut out thus reducing the quality of the wrapped yarn.

It has been determined that an important cause of end-down conditions in wrapping machines of the character under discussion is the fact that picked-up fiber waste accumulated on the ballooning binder strand would increase to such a mass and weight that centrifugal forces acting thereon would increase beyond the tensile strength of the binder strand. Such end-down condition is a particularly serious problem with the wrapped yarns in accordance with the afore-mentioned commonly assigned U.S. Pat. No. 3,831,369 because, when the binder strand breaks, wrapping about the drafted core strand ceases, the core strand cannot then sustain its own integrity and moves away from the delivery rolls toward the hollow spindle in the form of an uncontrolled mass of open fibers. Such uncontrolled fibers quickly disseminate in the air currents and often times will settle on other yarns being processed on the machine, thus degrading the quality of these other yarns or causing them to break and thereby aggravate the ends-down problem. A further problem arises when the binder strand ruptures and the core strand, rather than breaking immediately, continues to issue from the drafting system and becomes caught within the rapidly rotating spindle supporting the supply of binder strand. With the core yarn so trapped it eventually billows out of the top of the spindle either as a balloon still held at one of its ends by the spindle and still issuing out of the drafting system, or the core strand may break near the drafting system and the loose end held in the rotating spindle can flail about. In either event, the core yarn can then entangle with adjacent core strands, resulting in the break-out of these adjacent core strands in a domino effect.

c. Discussion of Prior Art

In commonly assigned U.S. Pat. No. 3,899,867 method and apparatus are disclosed and claimed for mechanically intermittently and partially collapsing the normal path of travel of the ballooning binder strand so as to impart a delaying movement thereto with consequential vibration of the balloon to cause most fiber waste picked up by the binder strand to be cast off by the same. While the method and apparatus of the -867 patent are effective for the objects just mentioned, it is always desirable to avoid any mechanical contact with a rapidly revolving yarn balloon. Furthermore, it has been found that in practice, particularly where the core strand is comprised of fibers of very short staple the amount of fly in the ambient air may be so great that it is advantageous to completely isolate the zone wherein the binder strand is ballooning to further insure that the binder strand is substantially free of any collections of fiber waste.

In a more recent addition to the prior art, U.S. Pat. No. 4,018,042, which is specifically concerned with a special combination of wrapped yarn properties as well as with the peculiar processing conditions needed to produce them, there is incidentally shown a balloon limiting cylinder approximately coextensive in length with the binder strand package supported on a driven hollow inner spindle, all rotating as an integral unit, and in an alternative embodiment a hollow package held within an external cylindrical container fixed on its bottom wall to the spindle and its upper wall projecting flange-like inwardly to a point spaced from the hollow spindle periphery and below the upper end of the spindle. In such arrangements, a binder balloon of considerable magnitude would necessarily develop in the open region outside the confines of these enclosures and especially in the immediate proximity of the entrance to the spindle bore, and thus to the wrapping zone itself. Consequently, the problems caused by the entrainment of airborne waste by the binder balloon are neither addressed nor resolved by the system of this patent.

STATEMENT OF OBJECTS

Accordingly, it is one object of the present invention to provide method and apparatus for insuring that the zone containing the ballooning binder strand being delivered for wrapping about a core strand is maintained essentially free of fly and other airborne waste by isolating said zone from such fly and airborne waste.

It is a further object of the present invention to provide method and apparatus for obtaining high quality wrapped yarn wherein the zone containing the ballooning binder strand being wrapped about a core strand to form the wrapped yarn is isolated by enclosure means including means for adjusting the binder strand egress gap therefrom to permit free advance of the ballooning binder strand from its source of supply to be helically wrapped about the core strand while substantially precluding entry into the isolated zone of fly and other airborne waste.

Other objects of the invention will in part be obvious and will in part appear hereinafter.

DESCRIPTION OF THE DRAWING

In the drawing:

FIG. 1 is a vertical sectional view of a yarn forming unit of the yarn wrapping machine of the present invention including a drafting unit, hollow spindle and yarn take-up means, and illustrating a preferred embodiment of apparatus in association therewith for generally isolating the zone wherein the advancing binder strand is ballooning so as to substantially preclude the entry of fly and other airborne waste into the binder strand ballooning area;

FIG. 2 is a view looking at the left-hand side of FIG. 1 substantially along lines II—II, but illustrating three of the yarn forming units of the machine;

FIG. 3 is an enlarged elevational view of the central portion of FIG. 1 and particularly illustrating details of the enclosure surrounding the supply of binder strand and the binder strand balloon which is formed as the binder strand advances off its supply source to be helically wrapped about a core strand advancing vertically downward from the drafting system;

FIG. 4 is an enlarged fragmentary view of the upper end of the binder strand enclosure illustrating details of the arrangement for adjusting the width of gap between the upper end of the enclosure and the uppermost end of the hollow spindle;

FIG. 5 is a top plan view illustrating details of the upper surface of the binder strand enclosure;

FIGS. 12 and 13 are grahs showing the variation in yarn tension during a production cycle with the preferred apparatus of the invention versus a conventional apparatus processing a mixed core yarn; while

DESCRIPTION OF THE PREFERRED EMBODIMENT

Figure 6:
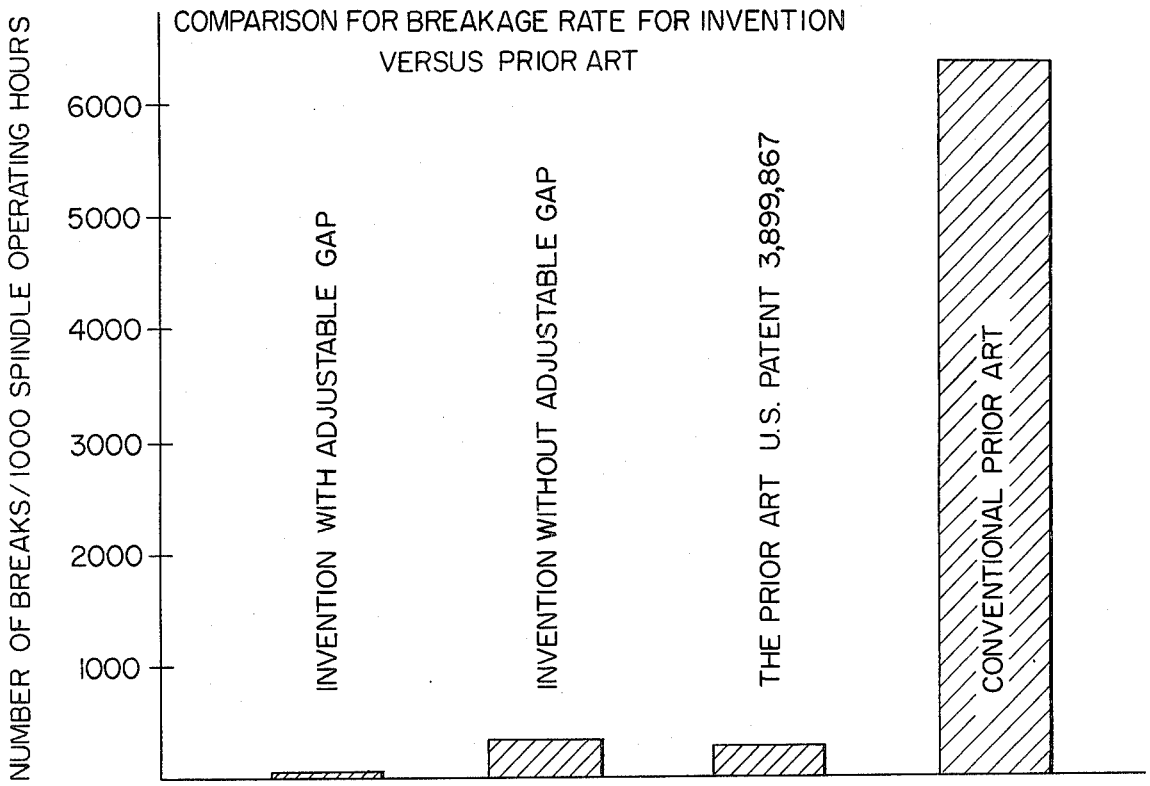
FIG. 6 is a block diagram comparing the effectiveness in reducing the breakage rate during wrapped yarn production of the improvement of the present invention, both in its broad and preferred embodiments, with conventional modes of wrapped yarn production.

With specific attention now to the drawings, suitable apparatus for forming wrapped yarn in accordance with the present invention is best shown in FIG. 1 as being of the general type disclosed in commonly assigned U.S. Pat. No. 3,831,369. One of the yarn forming units of a yarn wrapping machine is illustrated in FIG. 1, and three such units are partially illustrated in FIG. 2. It is to be understood that the yarn forming units are ganged in side-by-side relationship spaced along the length of a common supporting frame and are normally driven through a common drive belt from a single power source such as an electrical motor (not shown). As shown in FIG. 1, a strand of staple fiber such as roving R is taken off from a package or other suitable source 10. The roving R is directed downward through a trumpet guide 11 and drafted through a suitable drafting unit 12 shown extending in a generally vertical position and provided with a pair of delivery rolls 14 for delivering the drafted core strand S derived from roving R to the yarn covering or wrapping station generally designated 20.

The yarn covering or wrapping station 20 is located adjacent the upper or ingress end 24 of a hollow wrapping spindle 22 which may be of same construction as that disclosed in U.S. Pat. No. 3,831,369 capable of rotatably supporting thereon a removable spool 30 or other suitable package of a binder strand 32 which is wound on the spool 30. Binder strand 32 preferably is continuous and may be in the form of a continuous multi-filament synthetic thread such as nylon. As illustrated, each spool 30 may have flanges at opposite ends thereof. The upper end 24 of spindle 22 is desirably formed as a flat surface for purposes to be discussed hereinafter.

The machine is equipped with a suitable spindle driving member or belt 36 common to all of the spindles 22 along the machine and engaged by the spindles so as to rotate each of said spindles 22 during the forming of a related wrapped yarn Y. A binder strand 32 extends upwardly from each spool 30 and, due to high speed rotation of spool 30, centrifugal force causes the binder strand 32 to form a rapidly rotating balloon B as it travels from the periphery of spool 30 to the region of the wrapping station 20 adjacent the upper free end 24 of spindle 22 where commencement of the wrapping of the binder strand about the drafted core strand S occurs.

The binder strand 32 is wrapped about the core strand S, in the form of spaced apart helices as the core strand, in substantially untwisted condition, passes from the delivery rolls 14, downwardly through an axial yarn passageway 40 extending centrally through spindle 22 from one end to the other and to take-up rolls 44 or any other suitable take-up means. In a preferred embodiment, the hollow spindle 22 is constructed with the usual tubular body 46 having the axial passage or bore 40 extending therethrough and a whorl portion 48 for engagement by drive belt 36. The spindle 22 is supported in a bearing 50 supported in a stationary bearing housing 52 which, in turn, is affixed in a bracket 54, in turn, is pivotally mounted as at 56 to fixed frame member F which constitutes a portion of the wrapping machine support.

The lower end portion of the tubular body 46 of each spindle 22 extends through its associated supported bracket 54 and related bearing 50 as shown in FIG. 1, and has suitable means associated therewith constituting an air flow passageway. Thus, with reference to FIG. 1, the air flow passageway is defined by a respective air flow suction tube or conduit 60 having one end connected to the lower neck-like end 61 of bearing housing 52, and, consequently, to the axial passage 40 extending through spindle 22 and having the other end thereof extending to a suitable suction and collecting device schematically shown at 62 in FIG. 1. It will be appreciated that suction and collecting device 62 extends along the full length of the wrapping machine and is common to all of the wrapping positions along that side of the machine.

Accordingly, a continuous suction air flow is induced along the axial passageways 40 of the plurality of hollow spindles 22, this suction air flow being in the direction of movement of the wrapped yarn through each spindle to prevent waste material, such as lint and other airborne waste, from accumulating in the hollow spindles and interfering with passage of the wrapped yarn therethrough. The suction air flow also aids in directing the fibers of the drafted strand S into the upper end of passage 40 of each spindle 22 during the wrapping of the binder strand 32 about the drafted strand. It will be observed in FIG. 1 that the lower portion of the wall of the suction tube 60 is provided with a suitable eyelet or egress opening 66 therethrough for passage of the helically wrapped yarn Y from the lower end of spindle 22 through the suction tube 60 to take-up means 44.

It has already been mentioned that each spindle 22 and its related parts are supported in a pivotable bracket 52. Each bracket 52 is provided with a generally upstanding operating level 70 by which means the machine operator can exert a generally downward pressure to pivot spindle 22 and its associated parts mounted on bracket 52 downwardly and outwardly to provide access to spindle 22 as when donning and doffing packages of binder strand 32 onto spindle 22. Such position is illustrated by the left-hand yarn forming unit in FIG. 2. Suction tube 60 is formed of flexible material such as plastic to permit ready flexing of the tube during the pivoting motion of bracket 52 and spindle 22. When spindle 22 is pivoted downwardly to the position of the left-hand station in FIG. 2, whorl 48 is withdrawn from engagement with drive belt 36 to thereby halt rotation of the spindle. Similarly, when spindle 22 is returned to its vertical position as shown in FIG. 1, whorl 48 once again engages belt 36 to thereby impart rotation to the spindle.

For further features of the covering or wrapping machine just described reference should be had to the disclosure appearing in commonly assigned U.S. Pat. No. 3,831,369 which is incorporated herein by reference.

As has been stated earlier herein, substantial amounts of airborne fiber waste in the form of rather fine fibers, generally known in the trade as fly, are generated by textile machines which process staple fibers and form textile yarns therefrom. In the absence of any means for controlling the presence of fly in the area of the ballooning binder strand, the fly will be picked up by and will adhere to the balloon B and will continue to accumulate on the balloon until a large fiber waste mass or wad or, as it is sometimes called, "flag", is accumulated thereon. The flag increases the outward or centrifugal force acting on the ballooning binder strand so that, if the flag does not break away from the binder strand or is not otherwise released therefrom, the flag continues to increase in size and results in rupture of the binder strand. As has already been discussed, this ruptured condition, in turn, might release the core strand to rotate rapidly and become engaged with adjacent core strands thus causing a cascading effect breaking out a plurality of further core strands along the wrapping machine. Also, if the wads of fiber waste adhere to and are caused to move upwardly along the binder strand, such wads or flags are wrapped around the binder strand to form objectionable slubs in the wrapped yarn being formed.

According to the present invention, in order to obtain a high quality wrapped yarn and to reduce the occurrence of ends-down conditions, there is provided an improved method and apparatus for isolating the binder strand ballooning zone, i.e., that region which contains the binder strand balloon up to its limit of where the binder strand enters the wrapping station 20 and thereby insuring that most of the fiber waste generated during drafting or present in the ambient air surrounding each wrapping station is excluded from the binder strand ballooning zone during formation of the wrapped yarns. To this end, an enclosure 76 is provided which, except for a necessary ingress or entrance opening for the drafted roving S encloses the upper end of spindle 22 defining the wrapping station 22 and extends in surrounding relation about substantially the supply of binder strand 32. As will be discussed further hereinafter, enclosure 76 is disposed outwardly from supply to permit the formation of balloon B as the binder strand advances to be wrapped about the core strand S. As best seen in FIGS. 1–3, enclosure 76 is stationarily supported on a rigid base 78 having a central aperture therethrough to permit free rotation of spindle 20. Base 78 is secured on an upright member 80 affixed at its lower end to bracket 54. Base 78 has a generally cylindrical, rigid wall 82 attached thereto and extending upwardly around the supply package of binder strand 32 and terminating in a generally frusto-conical section 84 situated somewhat above and adjacent to the upper end 24 of spindle 20. Wall 82 is spaced radially outward from spool 30 to delimit with the periphery of binder package 32 a sheltered zone 86 in which binder strand 32 can balloon as that strand advances for wrapping around drafted strand S. In the preferred embodiment, frusto-conical section 84 of enclosure 76 is hinged as at 90 to permit the frusto-conical section 84 to be opened, as shown in the left-hand spindle position illustrated in FIG. 2, to thereby provide easy access for attending to the supply of binder filament 32 positioned within enclosure 76.

While the exact region along the length of bore 40 of spindle 22 at which the actual wrapping of the binder strand takes place has not been precisely identified, and may well in any event be varying due to the dynamic conditions of the wrapping operation, clearly the ingress end opening of bore 40 is the earliest point where wrapping could be initiated, and this end opening can, therefore, be taken as the beginning or starting point of the wrapping station 20, i.e., the section of the apparatus within which the wrapping operation occurs. The end opening locus also defines for practical purposes the downstream end (in the direction of binder strand travel) of the binder strand balloon (the other end of that balloon lying on the package periphery and moving axially to and fro between the package ends as the binder windings are removed from the package). In approaching the end opening of bore 40, the binder strand necessarily runs in contact with the inner edge of spindle end face 18 which delimits bore 40 (and most likely with more extensive contact with end face 18 marginal to bore 40), and once such contact is made, the free ballooning condition of the strand terminates.

In accordance with the broad concept of the invention, the ballooning zone of the binder strand is sheltered within an enclosure or housing such as enclosure 76 formed of material impervious to ambient textile fly or lint and extending over substantially the entirety of that zone and particularly the portion of the ballooning zone adjacent the wrapping station 20. Hence, the downstream limit of the enclosure should project at least adjacent the entrance to the wrapping zone as defined by the entrance opening of bore 40 to insure the surrounding of the adjacent portion of the ballooning zone.

While, as will be subsequently documented, an enclosure meeting this broad requirement has proved effective to achieve substantial protection of the binder strand balloon from entrainment of airborne fiber waste, it is preferred that the downstream limit of the enclosure define with the upper end of the spindle 22 a constriction, desirably adjustable in dimension, which establishes restricted communication between the ballooning zone allowing free passage of the binder strand therethrough while maximally restraining fly from entering the ballooning zone therethrough and can, at the same time, define an entrance opening for core strand S to the wrapping zone. Such a construction has been found uniquely effective in excluding substantially all of the airborne waste from entering the zone 86 defined within enclosure 76, i.e., that zone in which balloon B is formed as the binder 32 advances to be wrapped around the core strand up to the point of proximity with the wrapping station entrance.

Thus, with particular attention at this point to FIG. 4 it will be seen that the upper end of frusto-conical enclosure section 84 has a threaded bushing 104 secured thereto in generally coaxial relation to the upper end of spindle 22 with the bore through the bushing being threaded to accomodate a mating sleeve 106. The shank 108 of sleeve 106 is threaded along substantially its full length and is provided with a mating check nut 110. The lower end 112 of shank 108 is extended radially as a flange or lip generally parallel to the upper end face 24 of spindle 22 and the overall length of the shank is sufficient to extend downwardly into zone 86 to a point where its lower end 112 can, if sleeve 106 is fully lowered, actually bear against the upper face 24 of spindle 22. In operation, a gap 116 defined between the mutually adjacent surfaces of flange 112 and spindle face 24 is created by elevating sleeve 106 a predetermined distance above the upper end face 24 of spindle 22 to afford passage through said gap of binder strand 32. In working tests of the present invention, it has been found that the amount of airborne waste entering zone 86, at least as manifested by the operational consequences of such waste, is generally proportional to the dimension of gap 116. That is to say, the greater the size of gap 116, the greater the operating difficulties which are considered attributable to the accumulation of airborne waste within zone 86. In these tests the roving was 50/50 cotton-polyester, 1½ in. staple length, or all cotton, 1 in. ave. staple length, and the binder yarn was polyester, 20 denier monofilament. The drafting system was an SKF-PK-235 manufactured by SKF Kugellagerfabriken GMBH of Stuttgart, Germany, and the draft was 36.6. Spindle 22 was operated at 20,000 RPM inserting 13 T.P.I. into strand S, the core yarn was 30S cotton count.

A first series of tests had, for its objectives, the determination of the magnitude of the basic problem encountered in the conventional yarn wrapping process, as a control, and then the comparative effectiveness in reducing this problem of (1) the improvement of prior art U.S. Pat. No. 3,899,867, (2) the balloon sheltering enclosure of the invention without the special gap adjusting feature, and (3) the balloon sheltering enclosure of the invention with the special gap adjusting feature. In these tests, a group of spindles constructed according to each of these arrangements 1–3 plus the control was operated for a given period of time and the number of breaks or ends down of any kind which occurred during the given operating period were recorded and converted to a common basis corresponding to the total number of breaks for 1,000 hours of spindle operation. The results of these tests are summarized in block diagram fashion in FIG. 6. From the data in FIG. 6, one learns that a tremendous number of breaks or ends down does, in fact, occur during the operation of the conventional yarn wrapping system, exceeding 6,000 breaks per 1,000 spindle hours. Translating this figure into practical terms, it follows that approximately 6 breaks would occur for each spindle hour or about one per spindle every 10 minutes. Assuming the aggregation in a commercial machine frame of a total of only 100 individual wrapping units or stations, it follows that a total of 600 breaks or ends down could be expected per hour of operation of the frame or 10 breaks per minute. It would be humanly impossible for a single operator to repair so high a frequency of breaks and maintain even one commercial frame in full operating condition which, obviously, would greatly add to the expense of operating this type of machine.

The improvement of the prior art -867 patent wherein the yarn ballon is intermittently intercepted on each revolution and vibrated to dislodge entrained fly does achieve a very substantial improvement in operation, reducing the extent of breakage by slightly over 90%. The binder strand sheltering enclosure of the invention, without the special gap adjusting feature, is roughly equally effective with the prior art -867 patent but without the necessity for physically intercepting the balloon during each rotation thereof with consequential potential degradation in the quality of the final wrapped yarn product or other undesirable results. Where, however, in the ideal practice of the invention the special gap adjusting feature is added to the balloon sheltering enclosure, the number of yarn breaks or ends down is reduced by more than 99% over a range of gap dimensions of about 0.004–0.112 in.

Figure 7:
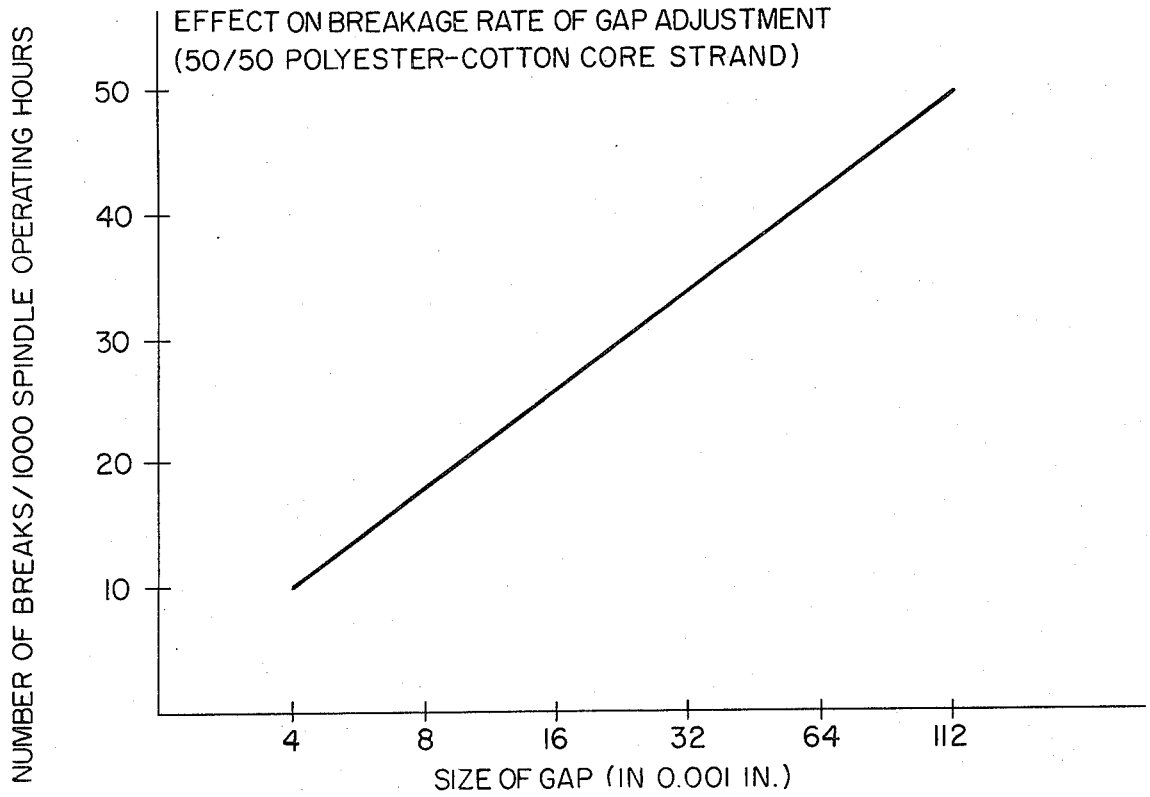
FIGS. 7 and 8 are graphs for a mixed polyester cotton core yarn and all cotton core yarn, respectively, of the rate of breakage as a function of the gap dimension in the preferred embodiment of the invention.
Figure 8:
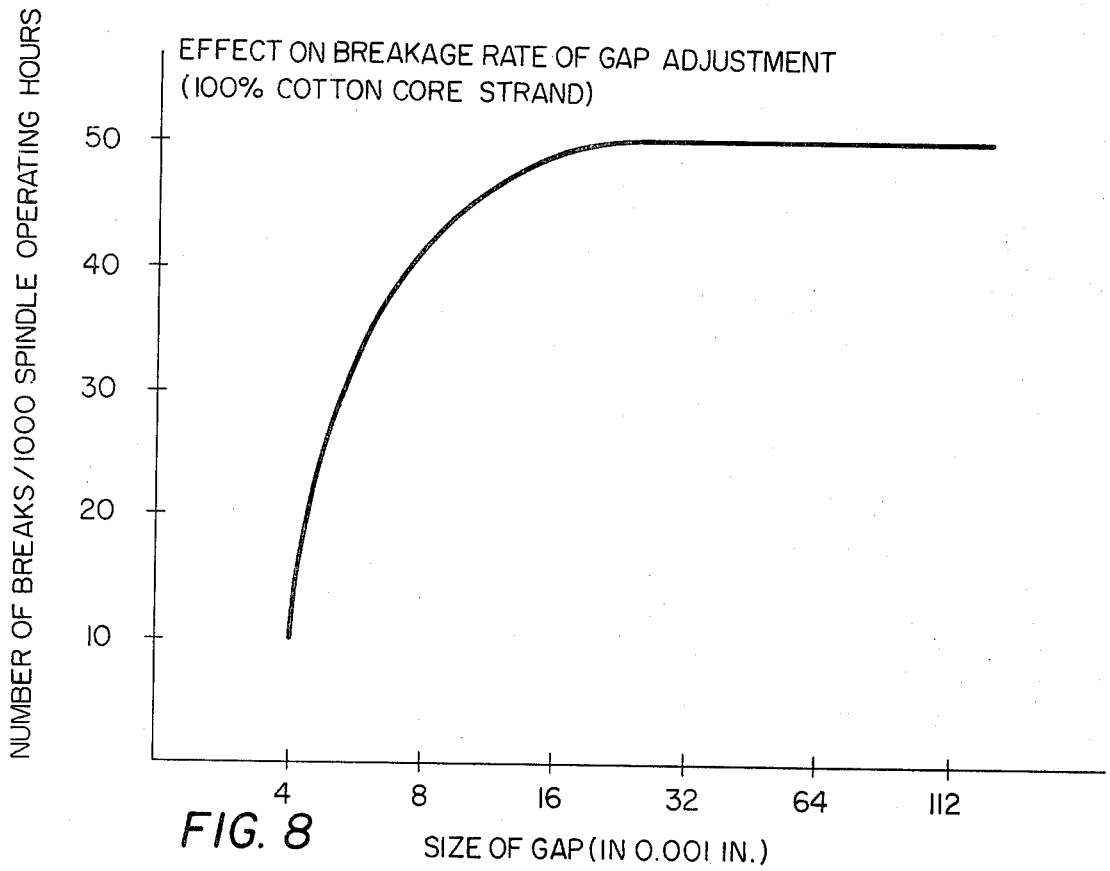

To provide specific indication of the effect on yarn breakage rate of varying the gap dimension according to the special feature of the invention within the just specified range of 0.004–0.112 in., an additional series of tests was carried out using, first, a core yarn constituted of a 50/50 mixture of polyester and cotton, and second, an all cotton core yarn, and the number of breaks occurring for each of these two types of core yarns is plotted in FIGS. 7 and 8 with the gap being set with a clearance dimension of 0.004, 0.008, 0.016, 0.032, 0.064, and 0.112 respectively, the last figure representing the maximum retracted position for the sleeve 106 that was possible with the test apparatus. The curves of FIGS. 7 and 8, show that for the "mixed" core yarn, the break rate with the gaps at the small end of this range is in the order of 20 or less per 1,000 spindle hours which virtually equals the ideal operation of the machine, while with gaps toward the upper limit, the break rate increased to only about 50 per 1,000 spindle hours. The break rate increases somewhat more rapidly with the all cotton core yarn, stabilizing at about 50 per 1,000 hours for a gap of about 0.016 and remaining virtually constant about that level, while the "mixed" core yarn varied essentially linearly between the two gap limits. This contrasting behavior cannot be reasonably explained with currently available information, although it would appear likely that if the gap were increased above the stated limit for the "mixed" core yarn, the break rate would likewise tend to stabilize at a maximum value. Even a break rate of 50/1000 spindle hours is within the limit of commercially acceptable operation, amounting to approximately 5 breaks per hour for a 100 position machine frame which means that a single operator could effectively tend to several of such frames with relative ease.

Figure 9:
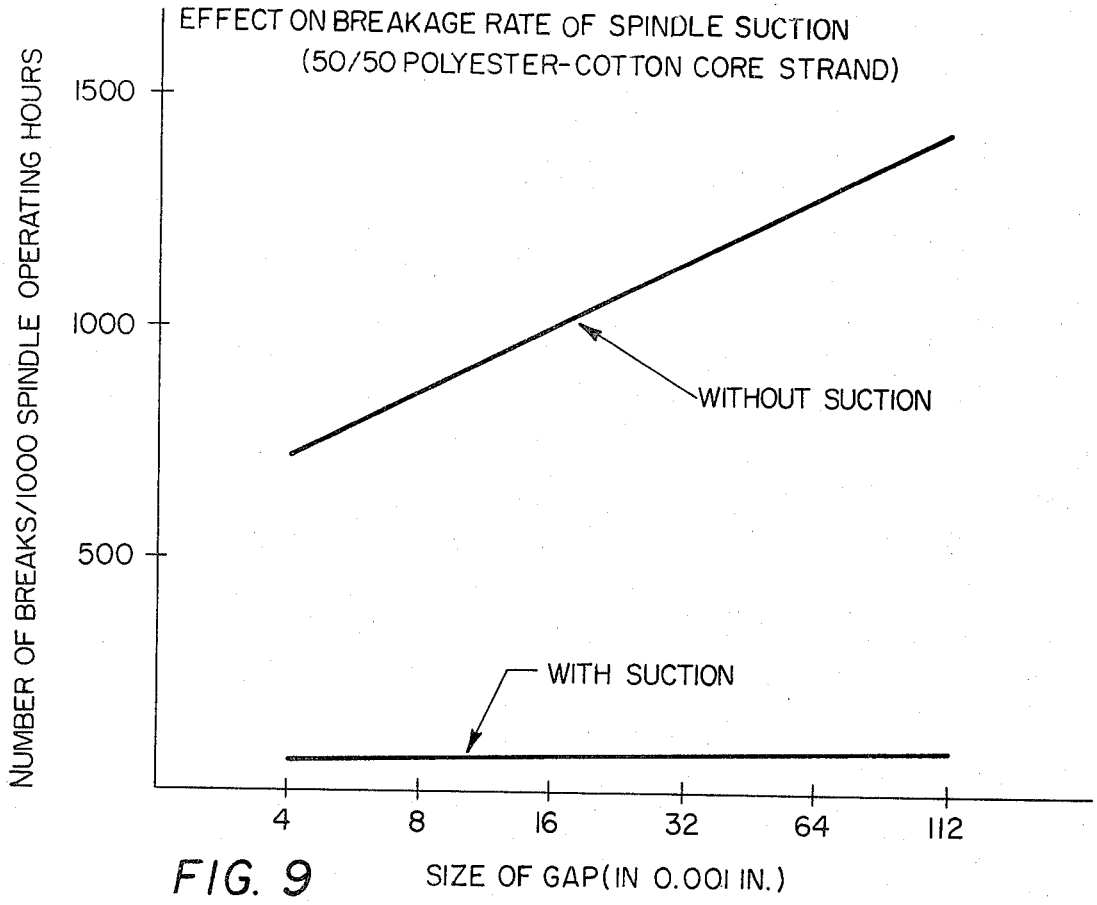
FIG. 9 is a graph similar to FIGS. 7 and 8 for a mixed core yarn showing the effect of creating suction within the wrapping zone correlated with the gap dimension in the preferred embodiment of the invention.

The inducement of an air flow current through the wrapping zone, by connecting the lower end of the spindle to a suction source, is already among the measures employed in the prior art, as evidenced by the same -867 patent. To illustrate the influence of this measure upon practical operation, tests similar to those above were carried out in a system utilizing the balloon sheltering enclosure of the invention in its preferred form incorporating the adjustable gap feature with and without this suction current, and the results of this comparison appear in FIG. 9. From these results, one observes that the suction current is an important adjunct to the features of the present invention as it presumably is to the system of the -867 patent as well.

Figure 10:
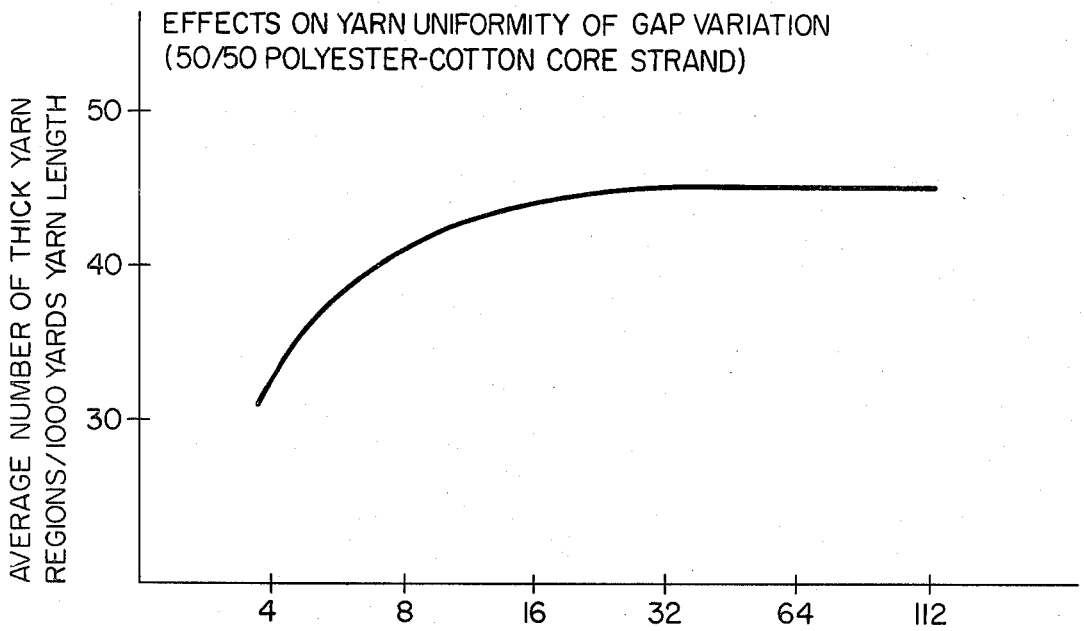
FIGS. 10 and 11 are plots of an analysis of the wrapped yarn product, obtained with a mixed and all cotton core yarn, respectively, for the occurrence of excessively thick regions therein as a function of the gap dimension in the preferred embodiment of the invention.
Figure 11:
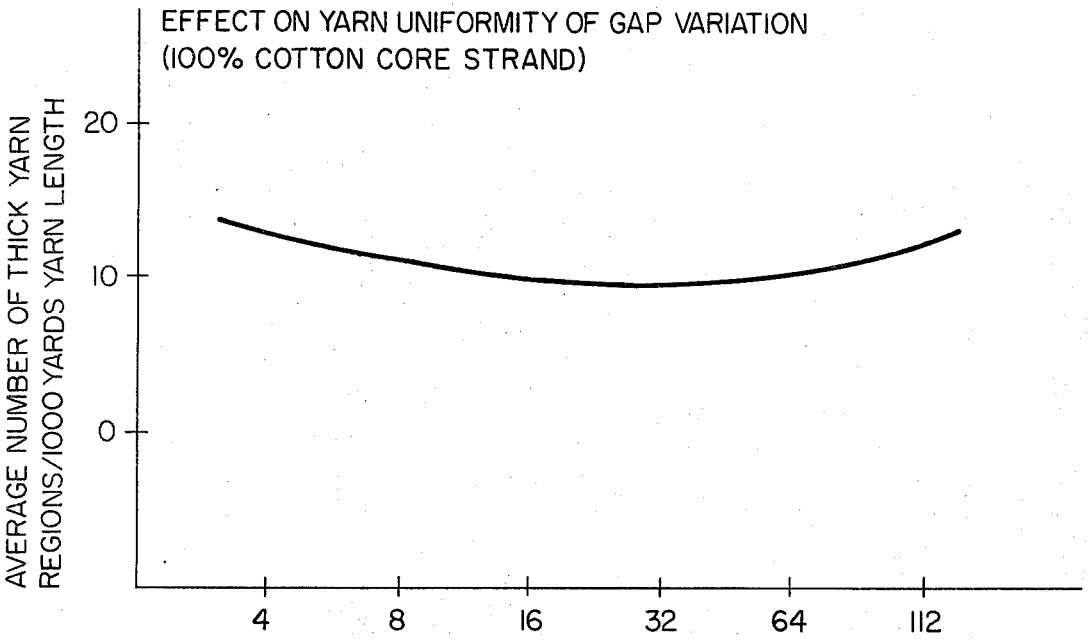

Mention was made in the introductory description of this specification of the possibility of the airborne fly entrainment becoming manifested in the creation of enlarged regions or slubs along the length of the ultimate wrapped yarn product even when such entrainment was not sufficiently serious as to bring about complete rupture in the strand being processed. To gauge the magnitude of this aspect of the problem, samples of wrapped yarn product which had been actually produced and collected independently of any breaks, were scanned for the occurrence of excessively thick regions or slubs along its length, by means of a suitable apparatus known in itself in the art for this purpose, namely, an Uster Model B Evenness Tester equipped with an Imperfection Indicator Attachment operated at a "sensitivity setting" of 3. The number of thick regions or slubs projected on the basis of 1,000 yards of yarn length is plotted in FIG. 10 and FIG. 11 for the mixed polyester/cotton core yarn and all cotton core yarn, respectively, over the gap range of 0.004–0.112. For the polyester core yarn, the number of thick regions was at a minimum with the narrower gap dimensions, while for the all cotton core yarn, the number of thick yarns remained essentially constant throughout the gap range, the apparent slight increase for the smaller gap dimensions being probably statistically insignificant.

Figure 12:
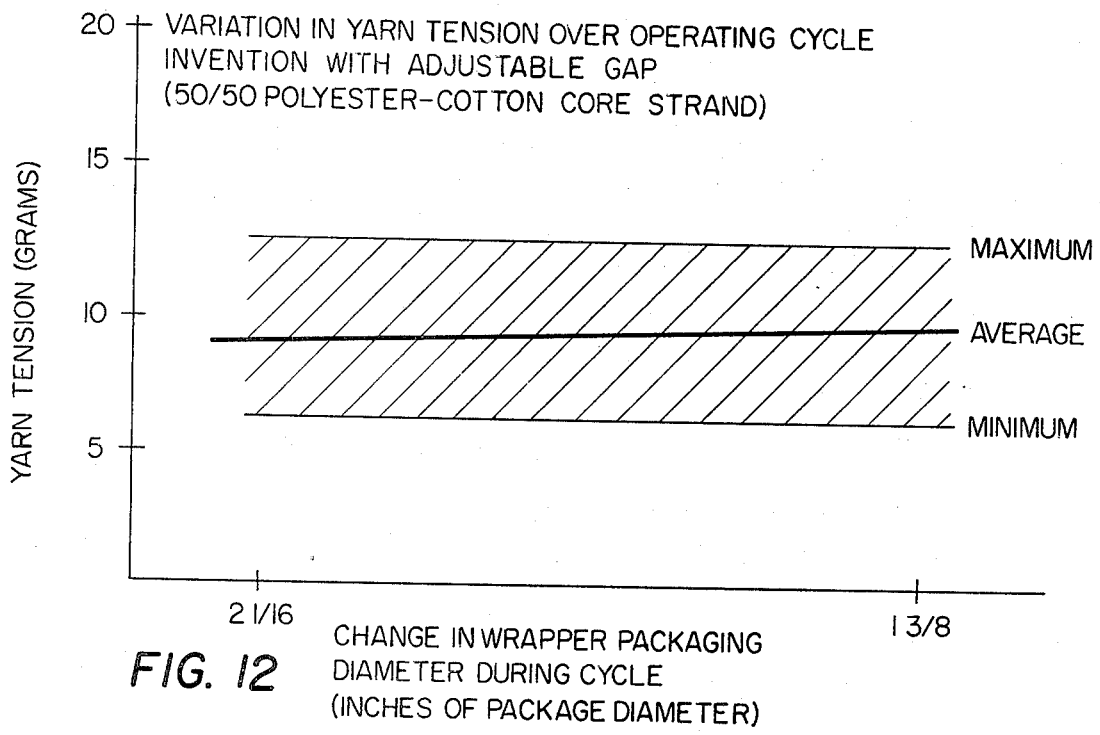
Figure 13:
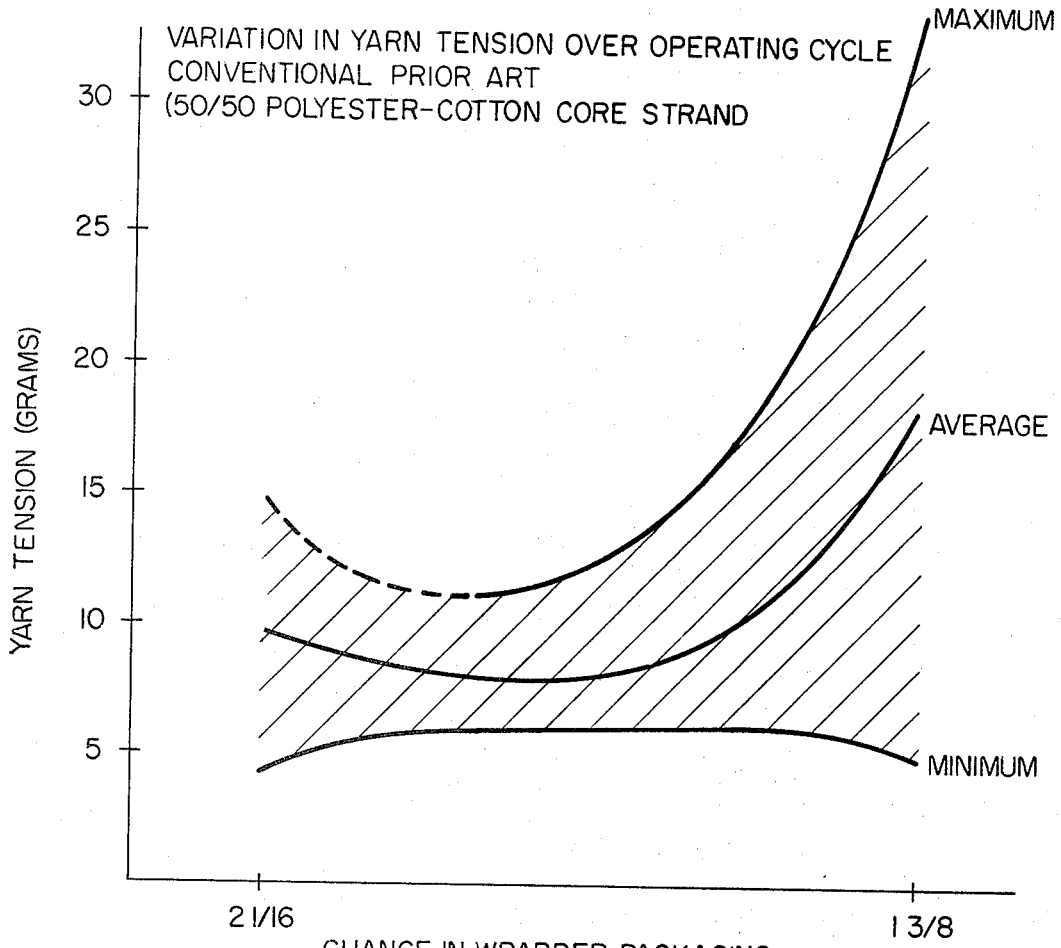
Figure 14:
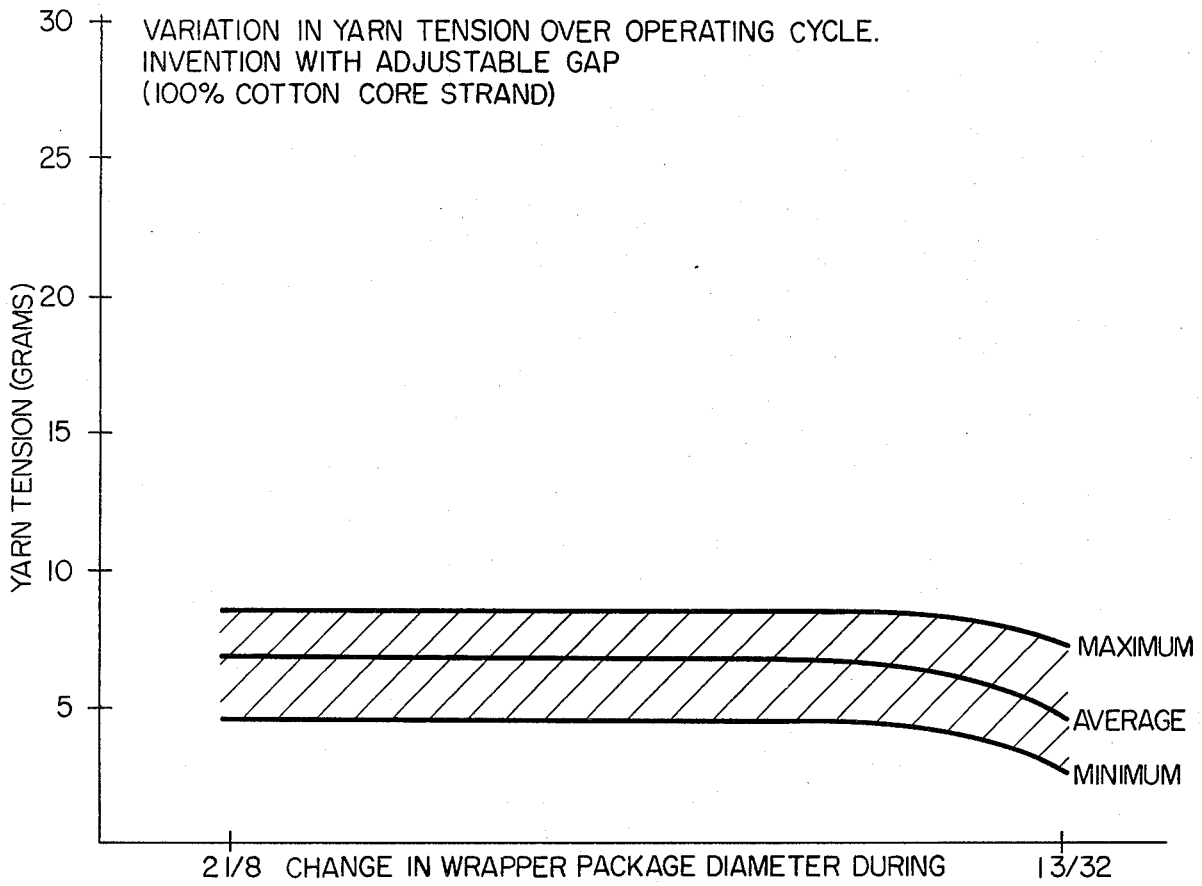
FIGS. 14 and 15 are similar graphs for an all cotton core yarn.
Figure 15:
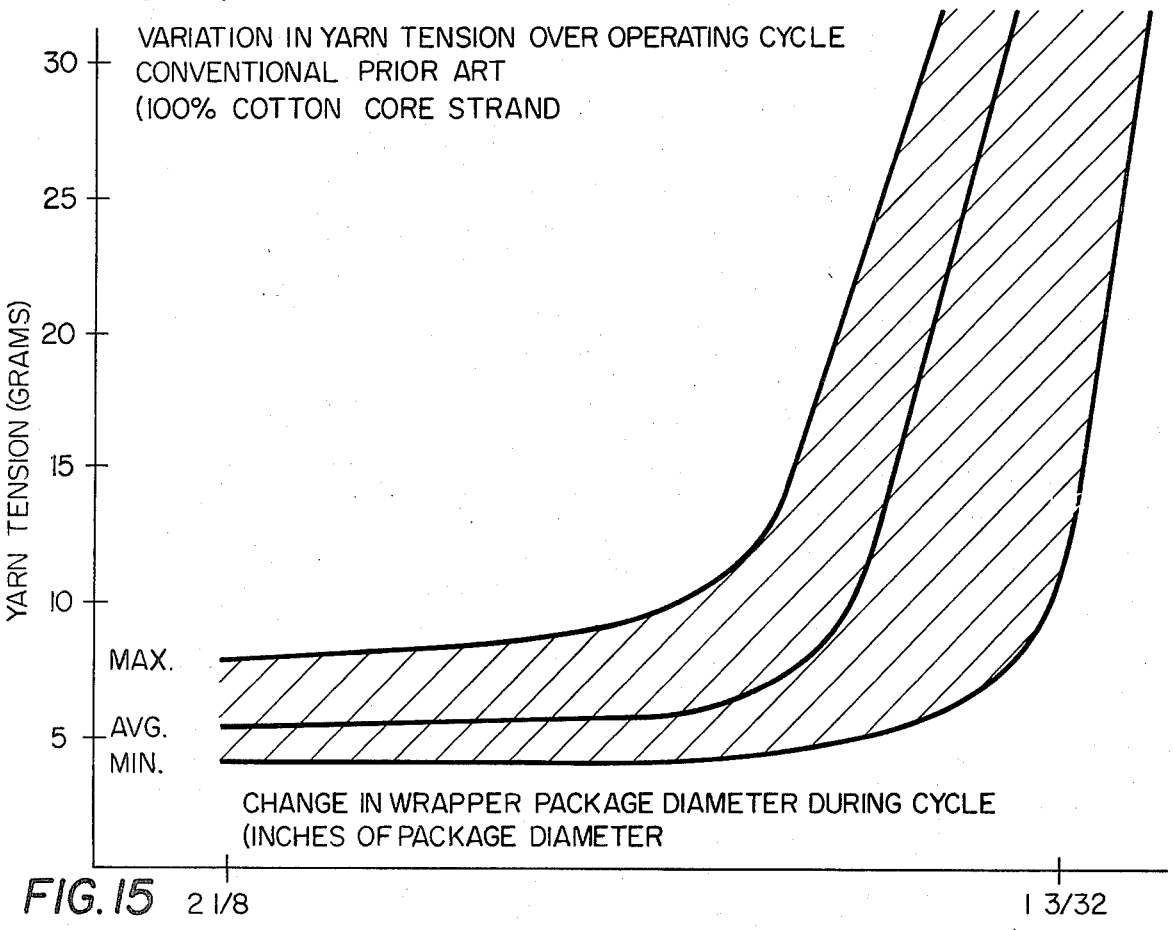

Finally, during experimental testing of the preferred embodiment of the invention, high and low tension readings were taken in the running wrapped yarn product at a point intermediate the lower end of the hollow spindle and the wrapped yarn collection package at periods during the test operation and these values plus an average are plotted in FIGS. 12 and 14 for both the "mixed" core yarn and the all cotton core yarn, respectively, in relation to the change in the wrapper filament package diameter during an operating cycle. Similar tension readings were taken periodically during a production cycle for the same yarns but processed in the conventional manner and these values likewise related to the wrapper filament package diameter at the time of measurement appear in FIGS. 13 and 15. As is evidenced from these four graphs, the operating tension in the product yarns produced in accordance with the ideal version of the present invention exhibit a high level of uniformity with beginning to end of the wrapping operation irrespective of the kind of core yarn being processed. In distinct contrast, the operating tensions for yarns produced in the conventional way, without any enclosure according to the invention, show drastic varition, rising sharply particularly near the end of the cycle. This means that the windings of the product yarn collected near the end of a cycle are under maximum tension and thus tend to cause packing or compression of the previously collected windings which were applied under much lower tension. Such a result is undesirable in the textile art particularly for a rather bulky yarn product as in the present invention, causing this product to lose some of its desirable loftiness. In addition, the application of later windings at high tension can cause these windings to become embedded in previous soft windings, leading to possible complications when the yarn product is unwound for fabrication into consumer goods or occasional rewinding prior to fabrication.

It is not understood at the present time why the running yarn shows such major tension variations when the wrapping operation is carried out in the conventional way, but these results confirm the general instability of the conventional wrapping operation because of the accumulation of lint or fly.

It was earlier pointed out that the upper end face 24 of spindle 20 is desirably a flat surface, and similarly, that the lower surface of shank end 112 is provided as a flat surface at least roughly coextensive with face 24 so that their surfaces are parallel as seen in FIG. 4. Thus, gap 116 is preferably an elongated radially directed passage extending between the end face 18 and flange 112, with a radial dimension or length which can conveniently approximately equal the annular thickness of spindle end face 24.

As is more fully discussed in the afore-mentioned U.S. Pat. No. 3,831,369, it is desirable that individual fibers of the roving constituting strand S have a staple length such as to be engaged at one end by the nip of delivery rolls 14 while their leading ends are being wrapped by binder strand 32. Consequently, since, as is apparent from FIG. 4, the wrapping of strand S occurs downstream of sleeve 106, it is desirable that this sleeve be of a length somewhat shorter than the average staple length of the fibers making up strand S so that the individual fibers have entered the spindle bore at their leading ends before being released at their trailing end from the nip of the delivery rolls 14.

It is thus seen that the present invention provides an improved method and apparatus for obtaining a high quality wrapped yarn Y by means of a wrapping operation wherein the balloon B formed by binder strand 32 as it is advanced to be helically wrapped around the core strand S is isolated virtually up to its entry to the wrapping station by the zone 86 from the ambient conditions surrounding the machine as well as from the path of the core strand itself to thereby prevent the formation of flags on binder strand 32 by accumulation of the fiber waste which otherwise tends to adhere to the balloon binder strand. The provision of an air flow passageway 60 connecting the hollow spindle 22 to the source of suction 62 to induce an air flow into and through the spindle in the direction of movement of the wrapped yarn therethrough aids in directing the core strand S into the hollow spindle 20 and, as already indicated, in inducing any fly entering the aperture through sleeve 106 downwardly through passage 40 of the spindle. Moreover, and more importantly, the isolation of zone 86 can be optimized to the requirement of a particular set of operating conditions by the provision of gap 116 of adjustable dimension between the upper end face 24 of spindle 22 and the lower end of sleeve 106 for emergence of the binder strand therefrom so that, while binder strand 32 remains free to advance for helical wrapping about the core strand S, the communication between zone 86 and the ambient atmosphere is controlled and confined so as to increase the resistance to fly entering zone 86. It follows that by precluding the entry of significant fly into zone 86 the opportunity for flag formation on binder strand 32 is essentially minimized or even virtually eliminated and the substantial disadvantages attending flag formation on the ballooning binder strand, which have been discussed earlier herein, are avoided.

It has been observed that during the operation of a single spindle unit or position under controlled laboratory conditions where the presence of randomly airborne fly or lint in the ambient atmosphere surrounding that spindle unit generally was virtually nonexistent, the spindle nevertheless suffered the problem of lint accumulation on the binder strand balloon with the consequential formation of flags and a high rate of ends-down due to yarn breakage to a series extent when operated in the conventional way without the improvement of the present invention. Since the ambient atmosphere during operation under these conditions itself contained virtually no lint or fly which could have been entrained by the ballooning binder strand, it follows logically that the source of the fly or lint which did, in fact, accumulate during such operation must have been the fly or lint generated during the drafting and related handling of the core strand of this unit itself. This conclusion suggests that an important, and possibly critical function, performed by the improvement of the invention is the containment of the fly or lint generated in the region between the nip of the drafting delivery rollers and the ingress end of the wrapping zone, as a consequence of the drafting operation and the movement of the strand through this region, and prevention of the fly or lint from escaping or being dispersed away from the path of the advancing core strand into the region of the ballooning binder strand. This being the case, the lower limit of the enclosure 76 may well serve a less necessary role in achieving the objectives of the invention so that it might well not be required that the lower limit of such enclosure be fully coextensive in length with the binder strand package or that the lower skirt of the enclosure be entirely impervious to textile lint or fly. However, the provision of a full enclosure, as shown in the drawings, may well have practical advantages from the standpoint of design and constructional simplicity if not from the standpoint of operating effectiveness directly.

In the drawings and specification there has been set forth a preferred embodiment of the invention and where specific terms are employed, they are used in a generic and descriptive sense only and not for purposes of limitation.

What is claimed is:

1. Method for manufacturing wrapped yarn wherein a binder strand advancing from a supply source mounted on a rotatably driven hollow spindle and rotating therewith is wrapped helically about a core strand introduced from a remote source into one end of said hollow spindle and passing through the bore of the spindle to form a wrapped yarn and wherein the advancing binder strand balloons in its path of advance from its rotating supply to said core strand being wrapped, comprising the steps of: substantially enclosing said binder strand balloon and the ingress end of said hollow spindle in a zone isolating the same from the ambient atmosphere while providing an ingress guide opening toward the bore of said hollow spindle for guiding said core strand to said bore from a core strand source remote from said spindle.

2. The method of claim 1 wherein said ingress guide opening forms the limit of said enclosing zone adjacent the spindle ingress end and including the step of spacing said guide opening a predetermined distance from said ingress end of said spindle to form a restricted passageway for said binder strand to advance for wrapping about said core strand proximate to the ingress end of said spindle while substantially precluding entry of loose fibers into said zone.

3. A method as set forth in claim 1 including the step of inducing an airflow through the bore of said spindle in the direction of movement of the wrapped yarn.

4. A method as set forth in claim 1 wherein the step of spacing said guide means a predetermined distance from said spindle ingress end includes maintaining said spacing at least 0.002 inches greater than the diameter of said binder yarn.

5. A method as set forth in claim 1 wherein said core strand is comprised of a plurality of discontinuous fibers delivered from a drafting system, and wrapping of said binder strand about said core strand is effected while maintaining at least some of said fibers being wrapped in the grip of said drafting system.

6. In a method of manufacturing wrapped yarn wherein a core strand is passed continuously from a remote supply through the bore of a hollow rotatably driven spindle having a free end defining the ingress end of said bore, and a binder strand is delivered from a supply package mounted on said spindle and rotating therewith to the ingress end of said spindle bore to be wrapped around said core strand while traveling through said spindle bore, said binder strand revolving in a ballooning zone extending from the package periphery to the free end of said spindle, the improvement of confining substantially the entirety of said ballooning zone in an enclosure impervious to airborne textile lint or fly, said enclosure terminating in the direction of balloon travel at least generally adjacent the free end of said spindle and defining with said free end an annular exit passage for the binder strand, said enclosure termination providing an access opening for the introduction of said core strand to said spindle bore.

7. The method of claim 6 including the step of constricting the axial extent of said radial passage to resist the entrance therein of textile fly or lint without substantially impeding the freedom of movement of said binder strand through said passage.

8. The method of claim 6 including the step of adjusting the axial extent of said radial exit according to operating conditions.

9. The method of claim 6 wherein the margins of said enclosure adjacent said core strand access opening extend generally parallel to the free end of said spindle.

10. The method of claim 6 wherein said core strand is constituted of an endless bundle of staple fibers having a predetermined average staple length formed by drafting means including a delivery set of drafting rolls and the ingress end of said spindle bore is spaced from the nip of said delivery roll set a distance less than said average staple length.

11. In a method of manufacturing wrapped yarn wherein a core strand of staple fibers is passed continuously from a remote supply along a path through the bore of a hollow rotatably driven spindle having a free end defining the ingress end of said bore, and a binder strand is delivered from a supply package mounted on said spindle and rotating therewith to the ingress end of said spindle bore to be wrapped around said core strand while traveling through said spindle bore, said binder strand revolving in a ballooning zone extending from the package periphery to the free end of said spindle, the improvement of guiding said core strand toward the ingress end of said spindle bore through an elongated guide zone formed of material impervious to textile fly or lint and surrounding said core strand over a portion of its path adjacent said spindle, said guide zone terminating at its downstream end in close spaced proximity to the free end of said spindle to permit the passage of said binder yarn through the clearance space therebetween while restricting the penetration through said space by textile fly or lint released from said staple fiber core strand whereby the entrainment of staple fibers by said binder strand balloon is reduced.

12. The method of claim 11 wherein the downstream termination of said guide zone is extended radially generally parallel to said free spindle end to increase the resistance to penetration of said clearance space by said textile fly or lint.

13. In an apparatus for manufacturing wrapped yarn wherein a binder strand advancing from a supply source mounted on a rotatably driven hollow spindle for rotation therewith is wrapped helically about a core strand moving from a remote source into the ingress end of said spindle and through the bore of said spindle to form a wrapped yarn and wherein the binder strand balloons in its path of advance from its rotating supply to said core strand being wrapped comprising, in combination, the improvement comprising enclosure means for enclosing said balloon in its substantial entirety up to said ingress end of said spindle to isolate said balloon from airborne textile fly or lint while providing an opening for the passage of said core strand to said spindle bore from said remote source.

14. The apparatus of claim 13 wherein said enclosure extends into spaced proximity with said spindle ingress end and is spaced apart a distance to provide a clearance gap of predetermined size sufficient to provide free passage of said binder strand to the bore of said spindle for wrapping about said core strand while precluding entry of loose fibers into said zone.

15. Apparatus as set forth in claim 13 including means for adjusting the size of said clearance gap.

16. Apparatus as set forth in claim 13 including means for rotating said spindle, means mounting said spindle and said enclosure for pivotal movement from a first position where said spindle is engaged with its driving means to a second position where said spindle is disengaged from said driving means.

17. Apparatus as set forth in claim 13 wherein said enclosure means includes a top portion, and means mounting said top portion for movement between open and close positions.

18. Apparatus as set forth in claim 13 wherein said core strand is comprised of a plurality of discontinuous fibers delivered from a fiber drafting system, and wherein the ingress end of spindle is positioned close to said drafting system to thereby maintain at least some of the fibers gripped in said drafting system as said binder strand is wrapped thereabout.

19. Apparatus as set forth in claim 13 wherein said enclosure means includes a surface facing the ingress end of said spindle, said surface and said ingress end being generally flat and parallel to each other.

20. Apparatus as set forth in claim 13 wherein said gap has a size at least approximately 0.002 inches greater than the diameter of the binder strand.

21. In an apparatus for manufacturing wrapped yarn wherein a core strand is passed continuously from a remote supply through the bore of a hollow rotatably driven spindle having a free end defining the ingress end of said bore, and a binder strand is delivered from a supply package mounted on said spindle and rotating therewith to the ingress end of said spindle bore to be wrapped around said core strand while traveling through said spindle bore, said binder strand revolving in a ballooning zone extending from the package periphery to the free end of said spindle, in combination, the improvement comprising an enclosure impervious to airborne textile lint or fly confining substantially the entirety of said ballooning zone, said enclosure terminating in the direction of balloon travel at least generally adjacent the free end of said spindle and defining with said free end an annular exit passage for the binder strand, said enclosure termination providing an access opening for the introduction of said core strand to said spindle bore.

22. The apparatus of claim 21 comprising means adjacent the termination of said enclosure for constricting the axial dimension of said radial passage to resist the entrance therein of textile fly or lint without substantially impeding the freedom of movement of said binder strand through said passage.

23. The apparatus of claim 21 including means for adjusting the axial position of said constricting means to vary the axial extent of said radial exit according to operating conditions.

24. An apparatus as in claim 21 wherein said constricting means comprising an annular flange disposed in proximity to said free end face of said spindle with the mutually adjacent surfaces of said flange and spindle end face being generally parallel to constitute an elongated annular exit passage for the binder strand.

25. An apparatus as in claim 24 comprising means for adjusting the position of said flange axially of said spindle to vary the separation between said mutually facing surfaces.

* * * * *